US005881866A

United States Patent [19]

Miyajima et al.

[11] Patent Number: 5,881,866

[45] Date of Patent: Mar. 16, 1999

[54] PUSH BUTTON SWITCH COVERING ASSEMBLY INCLUDING DOME CONTACT

[75] Inventors: Kenichi Miyajima; Hirohide Sato, both of Nagano-ken, Japan

[73] Assignee: Shin-Etsu Polymer Co., Ltd., Tokyo, Japan

[21] Appl. No.: 6,415

[22] Filed: Jan. 13, 1998

[51] Int. Cl.[6] ..... H01H 1/06; H01H 9/18; H01H 13/52

[52] U.S. Cl. ..... 200/513; 200/314

[58] Field of Search ..... 200/5 A, 512–517, 200/275, 308–317, 340–345

[56] References Cited

U.S. PATENT DOCUMENTS

| | | | |
|---|---|---|---|
| 4,343,975 | 8/1982 | Sado | 200/314 |
| 4,390,765 | 6/1983 | Sado et al. | 200/513 |
| 4,441,001 | 4/1984 | Miyano et al. | 200/308 |
| 4,636,593 | 1/1987 | Novak et al. | 200/5 A |
| 4,839,474 | 6/1989 | Hayes-Pankhurst et al. | 200/513 X |
| 4,862,499 | 8/1989 | Jekot et al. | 379/368 |
| 4,937,408 | 6/1990 | Hattori et al. | 200/314 |
| 4,952,761 | 8/1990 | Viebrantz | 200/513 |
| 5,234,744 | 8/1993 | Kenmochi | 200/314 X |
| 5,367,133 | 11/1994 | Schmidt et al. | 200/314 X |
| 5,635,927 | 6/1997 | Lin | 200/314 |

FOREIGN PATENT DOCUMENTS

| | | |
|---|---|---|
| 0554084 | 8/1993 | European Pat. Off. . |
| 0593804 | 4/1994 | European Pat. Off. . |

OTHER PUBLICATIONS

Patent Abstracts of Japan, vol. 097, No. 010, 31 Oct. 1997 & JP 09167540 A–Shin–Etsu Polymer Co. Ltd.–Jun. 24, 1997.

Patent Abstracts of Japan, vol. 096, No. 011, 29 Nov. 1996 & JP 08174716 –Shin–Etsu Polymer co. Ltd.–Jul. 9, 1996.

Patent Abstracts of Japan, vol. 096, No. 007, 31 Jul. 1996 & JP 08069726 A–Shin–Etsu Polymer Co. Ltd.–Mar. 12, 1996.

Patent Abstracts of Japan, vol. 013, No. 564, 31 Dec. 1989 & JP 01235108 A–Fujitsu Ltd.–Sep. 20, 1989.

Patent Abstracts of Japan, vol. 096, No. 011, 29 Nov. 1996 & JP 08185755 A–Shin–Etsu Polymer Co. Ltd.–Jul. 16, 1996.

*Primary Examiner*—J. R. Scott

*Attorney, Agent, or Firm*—McAulay Nissen Goldberg Kiel & Hand, LLP

[57] ABSTRACT

The push button switch covering assembly of the invention comprises a push button switch covering member made from a transparent rubbery material and a clicking member with a clicking diaphragm below the covering member which imparts the operator's finger tip with a sharp feeling of clicking when the key top of the covering member is depressed. Different from a conventional push button switch covering assembly of this type, in which the pushing load on the key top is transmitted to the top of the clicking diaphragm through a downward protrusion on the lower surface of the key top, the pushing load on the key top in this invention is transmitted to the clicking diaphragm by means of an upwardly raised part formed on the top of the upper surface of the upwardly convex clicking diaphragm so that the flat lower surface of the key top is fully available for forming a layer of indicia to indicate the particular function of the push button switch through the transparent key top without the disadvantage of wearing of the indicia as in the case where the indicia layer is formed on the upper surface of the key top.

5 Claims, 6 Drawing Sheets

FIG. 3A (PRIOR ART)
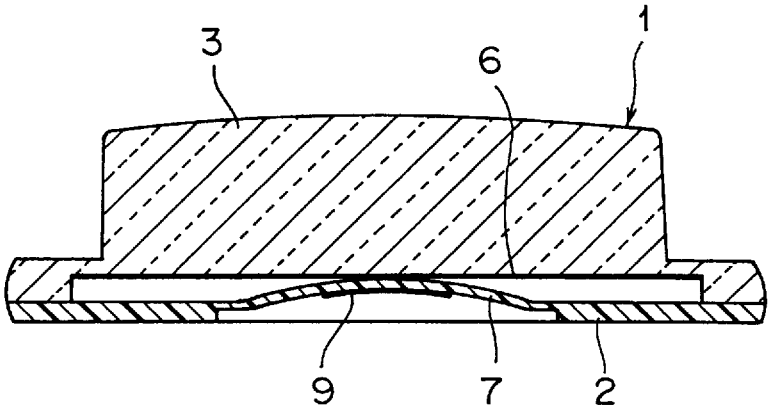
FIG. 3B (PRIORT ART)
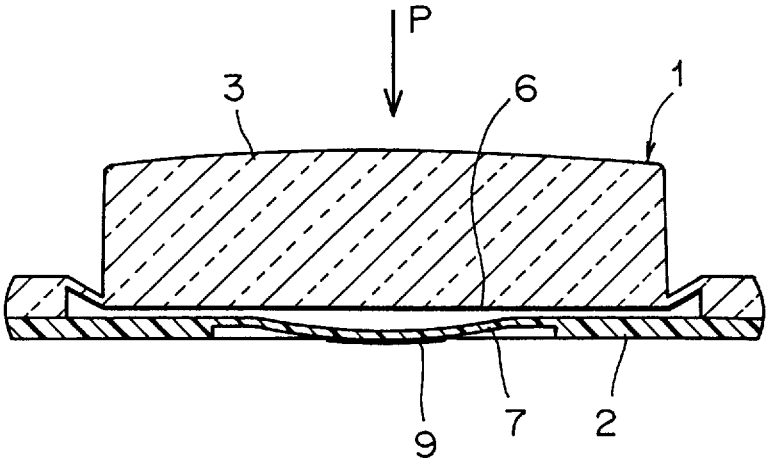

FIG. 7 (PRIOR ART)
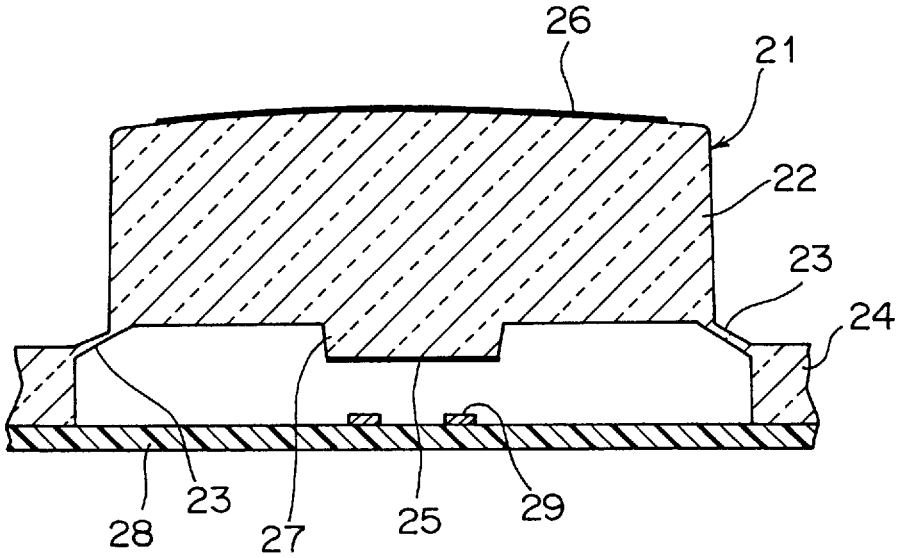
FIG. 8 (PRIORT ART)
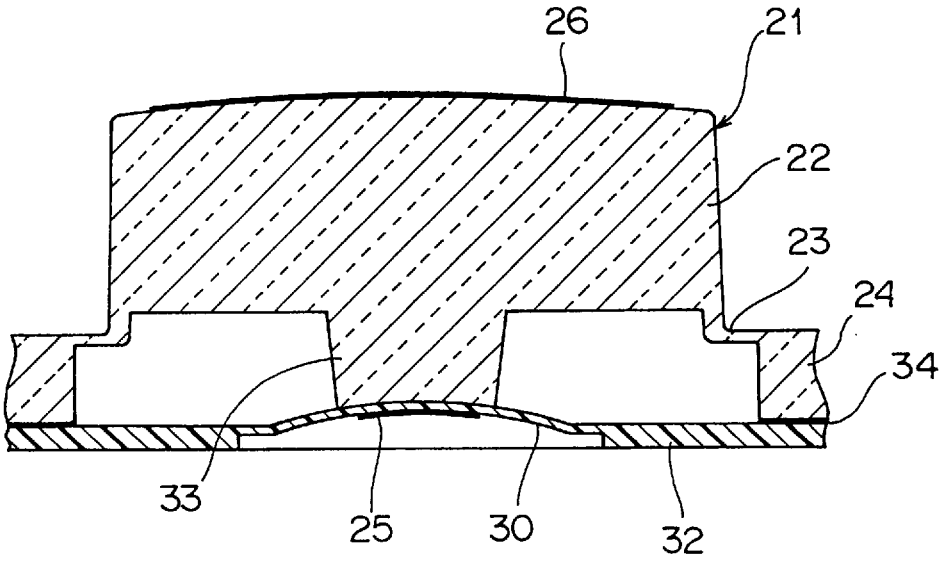

PUSH BUTTON SWITCH COVERING ASSEMBLY INCLUDING DOME CONTACT

BACKGROUND OF THE INVENTION

The present invention relates to a push button switch covering assembly or, more particularly, to a push button switch covering assembly consisting of a push button switch covering member and a clicking member therebelow to impart the operator's finger tip with a sharp and pleasant feeling of clicking despite a very small switching stroke when the push button of the switch is pushed down to close the electric circuit. Such a push button switch covering assembly is used in many electric and electronic instruments such as pocketable calculators, remote controllers of electric and electronic appliances, telephone panels and so on for inputting operation signals to the instrument.

FIG. 7 of the accompanying drawing illustrates a typical example of the push button switching unit of the prior art consisting of a push button switch covering member 21 and a base board 28 for signal inputting by a vertical cross sectional view. The push button switch covering member 21 is shaped integrally from a rubbery material such as a silicone rubber. The push button switch covering member 21 is an integral body consisting of a key top 22, a base plate 24 and a thin-walled riser part 23 connecting the key top 22 and the base plate 24 and resiliently deformable when the key top 22 is pushed down by the finger tip of an operator so as to bring the movable contact point 25 provided on the lower surface of a downwardly raised part 27 of the key top 21 into contact with a pair of fixed contact points 29 on the base board 28 of the switching unit thus to close the electric circuit between the fixed contact points 29. It is desirable in this assembly that the elastic deformation of the riser part 23 takes place with clicking caused by buckling so that the operator's finger tip receives a definite touch feeling of switching. It is usual that the top surface of the key top 22 is provided with a layer 26 formed by printing or attaching a printed seal or label bearing indicia such as numerical figures, signs and patterns.

One of the problems in the above described push button switch covering member 21 made from a rubbery material such as a silicone rubber is that, because the rubbery material has high flexibility as compared with conventional plastic resins, the phenomenon of clicking caused by buckling takes place only with a sufficiently large stroke of pushing which is possible only by increasing the distance between the key top 22 and the base board 28 of the switching unit and, even if the phenomenon of clicking can take place, the feeling imparted to the operator's finger tip is soft and rather obscure. Needless to say, the above mentioned large distance between the key top 22 and the base board 28 is contrary to the requirement in the modern electronic instruments designed for portability that the push button switching unit must have a thickness as small as possible.

FIG. 8 of the accompanying drawing illustrates a modified embodiment of the prior art push button switch covering assembly, in which the pushing-down stroke of the key top 22 is relatively small, by a vertical cross sectional view in which the riser part 23 of the push button covering member 21 is no longer responsible for occurrence of the phenomenon of clicking by buckling in pushing down of the key top 22. Instead, a clicking member 32, which is made from a relatively rigid plastic resin such as polyethylene terephthalate and polyethylene terephthalate, having a clicking diaphragm 30 in a downwardly concave configuration, is provided below the key top 22 in contact with the downwardly protruded presser 33. The clicking member 32 and the push button switch covering member 21 are usually bonded together by adhesion. A movable contact point 25 is formed, for example, by printing with an electroconductive printing ink containing carbon particles on the lower surface of the clicking diaphragm 30 just to oppose the presser 33. When the key top 22 is pushed down with an operator's finger tip, the clicking diaphragm 30 is also pushed down through the presser 33 at the top thereof so that the fixed contact point 25 on the lower surface of the clicking diaphragm 30 is brought into contact with the fixed contact points on the base board (not shown in FIG. 8). In this case, buckling deformation of the clicking diaphragm 30 takes place with resilience even when the pushing stroke is as small as to be 0.5 to 0.7 mm thus to impart a sharp and definite feeling of clicking to the operator's finger tip.

A problem in the push button switch covering assembly of each of the embodiments illustrated in FIGS. 7 and 8 is that, since the key top 22 of the push button switch covering member 21 is provided on the lower surface with a downward protrusion 27 or downwardly extended presser 33, the lower surface of the key top 22 is not available for printing of indicia but the layer of indicia 26 must be provided always on the upper surface of the key top 22. Needless to say, such a design of the layer of indicia 26 on the upper surface of the key top 22 is disadvantageous because the indicia are subject to wearing or fading away in the lapse of time due to rubbing or repeated pushing with an operator's finger tip.

As a solution of the above mentioned problem due to wearing or fading away of the indicia formed on the upper surface of the key top 22 of the push button switch covering member 21, a modification of the embodiment illustrated in FIG. 8 is proposed in which, as is illustrated in FIG. 9 by a vertical cross sectional view, the indicia layer 26 on the upper surface of the key top 22 is protected by adhesively bonding thereto a key top protector 22A made from a transparent material. In this embodiment, the indicia layer 26 is of course safe from wearing because the layer 26 is not exposed but sandwiched between the key top 22 and the key top protector 22A. The embodiment illustrated in FIG. 10 is a further modification of that of FIG. 9, in which the key top 22 is in the form of a readily deformable membrane with omission of the riser part 23 shown in FIG. 8. The embodiment illustrated in each of FIGS. 9 and 10, however, is disadvantageous because the key top protector 22A of a transparent material must be prepared separately from the push button switch covering member 21 and the separately prepared pieces of the key top protector 22A must be adhesively bonded each to one of the key tops 22 one by one with exact positioning resulting in a great increase in the production costs of the push button switch covering assemblies.

SUMMARY OF THE INVENTION

The present invention accordingly has an object to provide a novel and improved push button switch covering assembly consisting of a push button switch covering member and a clicking member without the above described problems and disadvantages in the prior art assemblies and capable of being manufactured at an outstandingly low cost.

Thus, the push button switch covering assembly of the present invention comprises:

(A) a push button switch covering member shaped from a light-transmitting rubbery material in an integral configuration consisting of (a) a key top of which the lower surface is flat.

(b) a base plate, and (c) a thin-walled riser part connecting the key top and the base plate, and provided on the flat lower surface of the key top with a layer showing indicia; and (B) a clicking member made from a plastic resin having an upwardly convex clicking diaphragm to face the flat lower surface of the key top in the push button switch covering member, the clicking member having an upwardly raised part or protrusion on the center of the upwardly convex clicking diaphragm to face the lower surface of the key top.

BRIEF DESCRIPTION OF THE DRAWING

FIGS. 3A and 3B are each a vertical cross sectional view of the push button switch covering assembly without a downwardly protruded presser and an upwardly raised part on the clicking diaphragm at the center in a normal state and in a pressed-down state, respectively.

FIGS. 7 and 8 are each a vertical cross sectional view of a prior art push button switch covering assembly without and with a clicking member, respectively.

DETAILED DESCRIPTION OF THE PREFERRED EMBODIMENTS

Figure 1A:
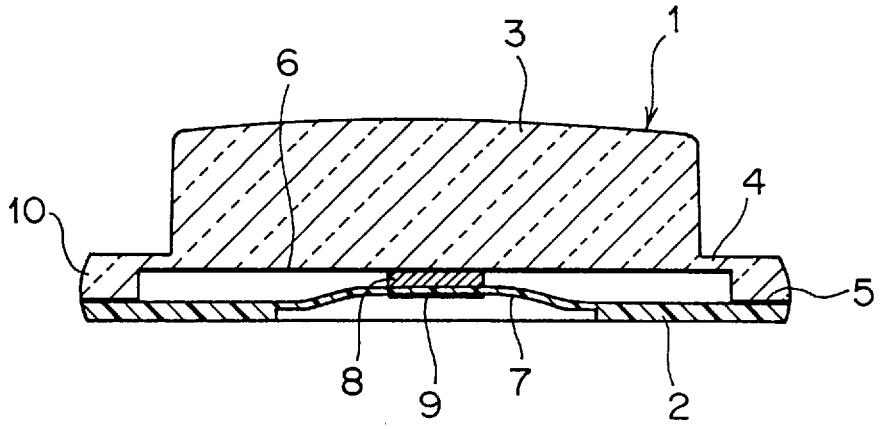
FIGS. 1A and 1B are each a vertical cross sectional view of the inventive push button switch covering assembly in a normal state and in a pressed-down state, respectively.
Figure 1B:
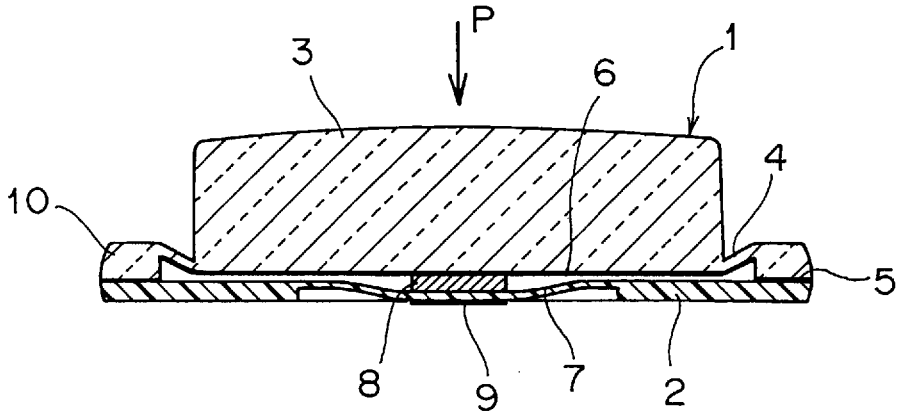
Figure 6:
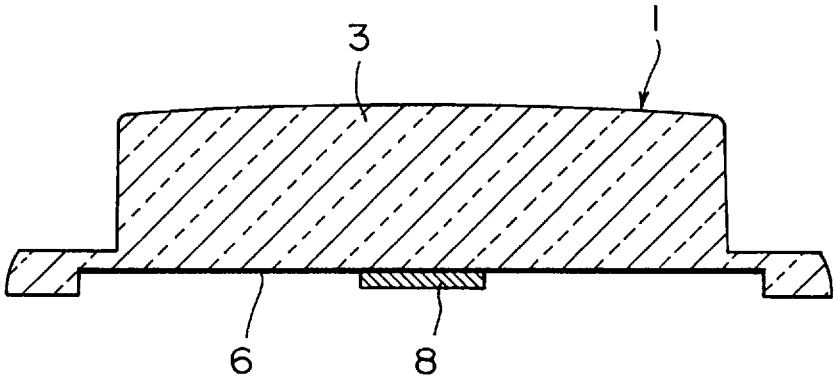
FIG. 6 is a vertical cross sectional view of a push button switch covering member having an upwardly protruded key top and a downwardly raised part.
Figure 9:
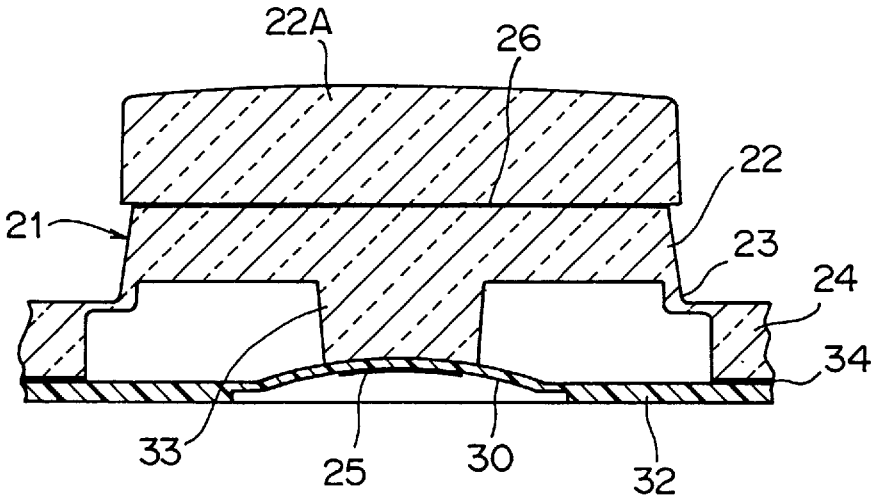
FIG. 9 (PRIOR ART)
FIGS. 9 and 10 are each a vertical cross sectional view of a prior art push button switch covering assembly with a clicking member and provided with a key top protector on a push button covering member of different types.
Figure 10:
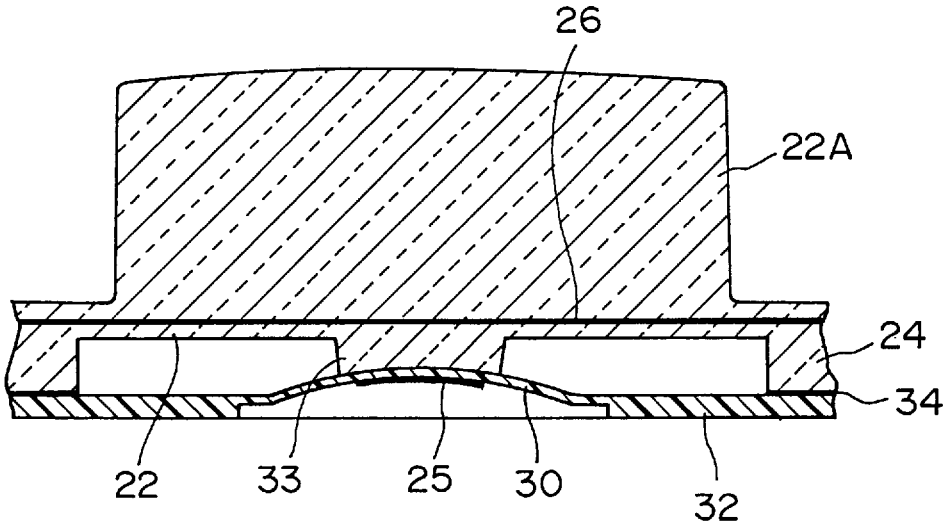
FIG. 10 (PRIOR ART)

As is described above, the most characteristic feature of the inventive push button switch covering assembly illustrated in FIGS. 1A and 1B is that, in place of the downwardly protruded presser 33 (see FIG. 8), the downward pushing force P applied onto the upper surface of the key top 3 is transmitted to the clicking diaphragm 7 by means of or through the upwardly raised parte or protrusion 8 formed on the upper surface of the clicking diaphragm 7. The upwardly raised part or protrusion 8 is preferably bonded by adhesion to the upper surface of the clicking diaphragm 7 using an adhesive although it is optional that, instead of providing the clicking diaphragm 7 with the raised part or protrusion 8, the key top 3 of the covering member 1 is provided on the lower surface by adhesive bonding with a downwardly raised part or protrusion 8 as is illustrated in FIG. 6 after forming the indicia layer 6 on the flat lower surface of the key top 3, for example, by printing in consideration of the simplified manufacturing process and less unevenness in the luminosity under illumination from backside.

The material of the push button switch covering member 1 is preferably a silicone rubber having transparency although other light-transmitting rubbers and elastomeric resins can be used therefor including polyamide-polyether copolymers, polyesters, polyester-polyether copolymers, polyurethanes, polyolefins, styrene-butadiene copolymers and ethylene-propylene-diene ternary copolymers.

The material of the clicking member 2, on the other hand, is a plastic resin having good stability with high heat resistance, high glass transition point, low thermal expansion coefficient and good mechanical properties relative to the tensile strength, ultimate elongation and Young's modulus as well as good workability in compression molding and draw molding. Examples of suitable resinous materials include polyethylene terephthalates and polyethylene naphthalates having polyester linkages in respect of adequate hardness and elastic modulus. Other plastic resins having a glass transition point of 110° C. or higher, such as polycarbonates, polyether sulfones, polyether imides, polysulfones and polybutylene terephthalates, can also be used as the material of the clicking member 2.

In the following, several embodiments of the present invention are described in more detail by making reference to the figures of the accompanying drawing.

FIGS. 1A and 1B are each an illustration of the push button switch covering assembly of the present invention in a typical embodiment in a normal state and in a pushed-down state with application of a downward force shown by the arrow P on the key top 3, respectively, by a vertical cross sectional view.

As is illustrated in FIG. 1A, the covering member 1, which consists of a key top 3, base plate 10 and riser part 4, and the clicking member 2 are adhesively bonded together with intervention of an adhesive layer 5 below the base plate 10. The key top 3 of the covering member 1 has a flat lower surface on which a coating layer 6 showing an indicia pattern is formed, for example, by printing. The center part of the clicking member 2 is shaped in the form of a dome-formed diaphragm which is downwardly concave or upwardly convex to serve as a clicking diaphragm 7. A raise or upward protrusion 8 is provided on top of the clicking diaphragm 7 to face the lower surface of the key top 3. The raised part 8 can be shaped integrally with the clicking diaphragm 7 by integral molding or can be formed by adhesively bonding a separately prepared disk-formed piece by using an adhesive. A movable contact point 9 is provided on the lower surface of the clicking diaphragm 7 just to oppose the raised part 8.

When a downward pressing load P is applied onto the upper surface of the key top 3 by the finger tip of an operator, as is illustrated in FIG. 1B, a phenomenon of buckling is caused in each of the thin-walled riser part 4 connecting the key top 3 and base plate 10 of the covering member 1 and the clicking diaphragm 7 imparting a clear and definite feeling of clicking to the operator's finger tip and the movable contact point 9 on the lower surface of the clicking diaphragm 7 is brought into contact with the fixed contact points (not shown in the figure) on the base board of the switching unit with a sufficient contacting pressure therebetween thus to close the electric circuit.

Figure 2A:
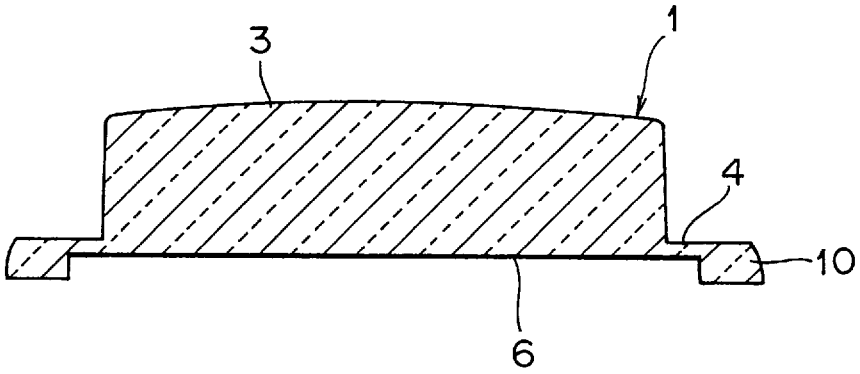
FIGS. 2A and 2B are each a vertical cross sectional view of the push button switch covering member and the clicking member, respectively, in the inventive push button switch covering assembly.
Figure 2B:
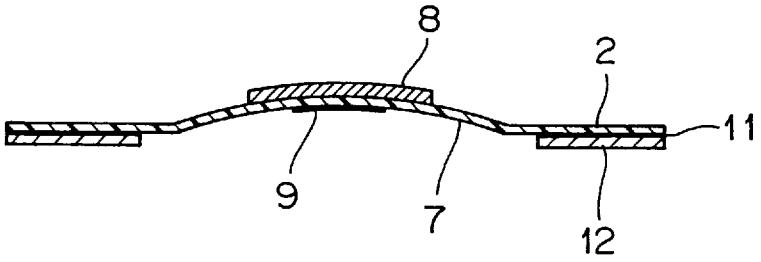

FIGS. 2A and 2B each illustrate the covering member 1 and the clicking member 2, respectively, by a vertical cross sectional view. The assembly of the present invention illustrated in FIG. 1A is obtained by mounting the covering member 1 at the base plate 10 thereof on the clicking member 2 and adhesively bonding them together with intervention of an adhesive layer 5. Different from the embodiment illustrated in FIG. 1A, the clicking member 2 illustrated in FIG. 2B is provided on the lower surface coming into contact with the base board (not shown in the figure) with spacers 12 in order to adjust the switching stroke of the movable contact point 9 to the fixed contact points therebelow. The clicking member 2 of this type with spacers 12 is advantageous because the clicking member 2 can be shaped from a thin plastic sheet having a uniform thickness so that the manufacturing costs of the clicking members 2 can be reduced so much. It is optional that the spacers 12 are provided with a channel to serve as an air escape when the clicking diaphragm 7 is downwardly depressed. The thickness of the spacer 12 can be selected such that a sufficient contacting pressure can be obtained between the movable contact point 9 and the fixed contact points on the base board but it should usually be smaller than the thickness of the raised part 8 on the top of the clicking diaphragm 7.

In contrast to the embodiment illustrated in FIGS. 1A and 1B, FIGS. 3A and 3B illustrate a similar but different embodiment of the assembly by a vertical cross sectional view, in which the clicking diaphragm 7 is not provided at the center top thereof with an upwardly raised part or protrusion 8 shown in FIGS. 1A and 1B with a flat lower surface of the key top 3. When the key top 3 is pressed down with application of a load P, reversal of curvature takes place in the clicking diaphragm 7 forming a gap space between the center of the clicking diaphragm 7 and the center of the lower surface of the key top 3 as is illustrated in FIG. 3B so that no definite contacting pressure can be obtained between the contact points and a feeling of clicking cannot be imparted to the operator's finger tip. The cause of this drawback is presumably that the initial contacting area is too large between the lower surface of the key top 3 and the upper surface of the clicking diaphragm 7. This problem can be solved by decreasing the area of the lower surface of the key top 3 available for contacting with the clicking diaphragm 7. While it is a desirable condition, in order to obtain a definite feeling of clicking with a sufficiently large stroke, that the clicking diaphragm 7 has a diameter smaller than 6 mm, on the other hand, a difficulty is encountered in designing the key top 3 to have such a small size of the lower surface thereof.

Accordingly, the upwardly raised part 8 on the upper surface of the clicking diaphragm 7 has a diameter smaller than that of the clicking diaphragm 7 per se. It is preferable that the surface area of the upwardly raised part 8 is in the range from 15% to 50% of the surface area of the clicking diaphragm 7.

Instead of forming the upwardly raised part 8 on top of the clicking diaphragm 7, it is an alternative way, as is illustrated in FIG. 6 by a vertical cross sectional view, that a downward protrusion 8 is formed on the center of the lower surface of the key top 3, for example, by using an ultraviolet-curable resin after a layer 6 of indicia is formed on the surface.

Figure 4:
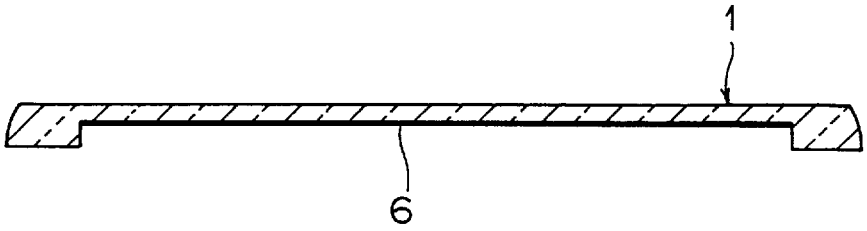
FIG. 4 is a vertical cross sectional view of a push button switch covering member of a flat type without upwardly protruded key top.
Figure 5:
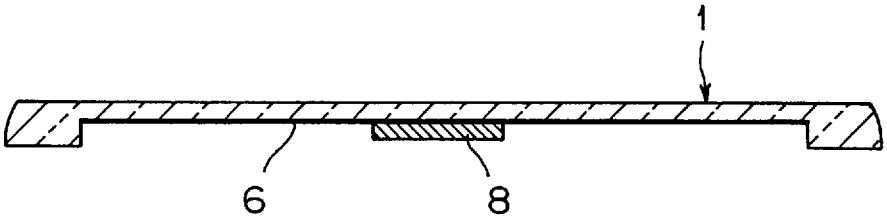
FIG. 5 is a vertical cross sectional view of a different embodiment of a push button switch covering member of a flat type without upwardly protruded key top but with a downwardly raised part.

FIG. 4 illustrates a push button switch covering member 1 of a different type called the flat-panel type having no thin-walled riser part 4 and heavy key top 3 in the covering member 1 illustrated in FIG. 1A but these two parts are integrated into a thin elastically deformable membrane so that the overall thickness of the push button switching unit can be greatly reduced even when this covering member is assembled with a clicking member, for example, illustrated in FIG. 2B. As is illustrated in FIG. 5 by a vertical cross sectional view, the flat-panel covering member 1 illustrated in FIG. 4 can be provided on the lower surface with a downward protrusion 8 at the center instead of forming an upwardly raised part on the upper surface of the clicking diaphragm 7 to be assembled with the flat-panel covering member 1. A sharp and definite feeling of clicking can be imparted also in the assembly with this flat-panel covering member to the operator's finger tip.

Needless to say, the various embodiments illustrated in the accompanying figures are described with a purpose of exemplification and never limitative. Although each of the figures illustrates a single covering member, a single clicking member or a single combination thereof, it is conventional to construct a multi-key push button switching unit by integrating a plurality of such a single combination of a covering member and clicking member in various arrangements with their covering members connected together at the base plates.

In the following, an example is given to illustrate the advantages of the present invention in more detail.

EXAMPLE

A light-transmitting curable silicone rubber stock was prepared by uniformly blending 100 parts by weight of a silicone rubber compound (KE-951U, a product by Shin-Etsu Chemical Co.) with 0.5 part by weight of a curing agent therefor (C-8A, a product by Shin-Etsu Chemical Co.). The silicone rubber stock was introduced into a metal mold and compression-molded at a temperature of 180° C. under a compressive pressure of 200 kgf/cm$^2$ into a push button switch covering member of a cured silicone rubber consisting of a 0.5 mm thick base plate, 0.2 mm thick thin-walled riser part and key top having a flat lower surface as is illustrated in FIG. 2A by a vertical cross sectional view. Further, a layer of indicia was formed on the flat lower surface of the key top by screen printing using a silicone-based printing ink.

Separately, a clicking member, as illustrated in FIG. 2B, having a downwardly concave clicking diaphragm of 5 mm diameter was prepared from a 0.1 mm thick sheet of a polyethylene terephthalate resin by draw molding. An electroconductive layer of 3 mm diameter to serve as the movable contact point was formed on the lower surface of the clicking diaphragm at the center by using a carbon-containing electroconductive ink. Further, an upwardly raised part having a diameter of 2.5 mm and a height of 0.15 mm was formed on the upper surface of the clicking diaphragm at the center by putting a few drops of an ultraviolet-curable liquid resin (Seikabeam SCR-SP-1, a product by Dainichi Seika Kogyo Co.) and irradiating the resin with ultraviolet light from a high-pressure mercury lamp to effect curing of the resin. With an object to provide an air escape, a 0.025 mm thick polyethylene terephthalate film was bonded to the lower surface of the clicking member around the clicking diaphragm by using an adhesive. The switching stroke of the clicking diaphragm was thus adjusted to 0.5 mm.

The thus prepared clicking member and the covering member were adhesively bonded together to give an assembly illustrated in FIG. 1A by using an adhesive which was prepared by blending 100 parts by weight of a silicone rubber compound (KE 106LTV, a product by Shin-Etsu Chemical Co.) with 10 parts by weight of a curing agent therefor (Catalyst RG, a product by Shin-Etsu Chemical Co.).

The thus prepared assembly of the covering member and the clicking member had an overall thickness of 0.95 mm excepting the key top and was capable of giving a sharp and pleasant feeling of clicking to the operator's finger tip despite the very small switching stroke of 0.5 mm when the key top was pushed down for switching.

What is claimed is:

1. A push button switch covering assembly which comprises:

(A) a push button switch covering member shaped from a light-transmitting rubbery material in an integral configuration consisting of (a) a key top of which the lower surface is flat, (b) a base plate, and (c) a thin-walled riser part connecting the key top and the base plate, and provided on the flat lower surface of the key top with a layer showing indicia; and (B) a clicking member made from a plastic resin having an upwardly convex clicking diaphragm to face the flat lower surface of the key top of the push button switch covering member, the clicking member having an upwardly raised part on the center of the upper surface of the upwardly convex clicking diaphragm to face the flat lower surface of the key top and having a movable contact point on the lower surface of the clicking diaphragm.

2. The push button switch covering assembly as claimed in claim 1 in which the light-transmitting rubbery material forming the push button switch covering member is a silicone rubber.

3. The push button switch covering assembly as claimed in claim 1 in which the plastic resin forming the clicking member is a polyethylene terephthalate resin or polybutylene terephthalate resin.

4. The push button switch covering assembly as claimed in claim 1 in which the surface area of the upwardly raised part on the upper surface of the upwardly convex clicking diaphragm is in the range from 15% to 50% of the surface area of the clicking diaphragm.

5. The push button switch covering assembly as claimed in claim 1 in which the key top and the thin-walled riser part of the push button switch covering member are integrated into the form of a flat membrane.

* * * * *